US010633973B2

(12) United States Patent
Kim

(10) Patent No.: US 10,633,973 B2
(45) Date of Patent: Apr. 28, 2020

(54) DISK ASSEMBLY AND TURBINE INCLUDING THE SAME

(71) Applicant: DOOSAN HEAVY INDUSTRIES CONSTRUCTION CO., LTD., Gyeongsangnam-do (KR)

(72) Inventor: Kyung Kook Kim, Daejeon (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 277 days.

(21) Appl. No.: 15/360,596

(22) Filed: Nov. 23, 2016

(65) Prior Publication Data

US 2017/0152747 A1 Jun. 1, 2017

(30) Foreign Application Priority Data

Dec. 1, 2015 (KR) ..... 10-2015-0169988

(51) Int. Cl.
*F01D 5/08* (2006.01)
*F04D 29/054* (2006.01)
(Continued)

(52) U.S. Cl.
CPC ..... *F01D 5/081* (2013.01); *F01D 5/066* (2013.01); *F01D 5/085* (2013.01); *F01D 5/10* (2013.01);
(Continued)

(58) Field of Classification Search
CPC ... F01D 5/02; F01D 5/026; F01D 5/06; F01D 5/066; F01D 5/048; F01D 5/085;
(Continued)

(56) References Cited

U.S. PATENT DOCUMENTS 2,779,531 A * 1/1957 Wheatley ..... F01D 3/04 415/104
8,641,365 B2 * 2/2014 Ahaus ..... F01D 5/066 415/111
(Continued)

FOREIGN PATENT DOCUMENTS

DE 102008054497 A1 6/2010
EP 1970528 A1 9/2008
(Continued)

OTHER PUBLICATIONS

Extended European search report issued by the European Patent Office dated Apr. 10, 2017 in connections with European Patent application No. 16201437.7.

*Primary Examiner* — Woody A Lee, Jr.
*Assistant Examiner* — Andrew Thanh Bui
(74) *Attorney, Agent, or Firm* — Invenstone Patent, LLC

(57) ABSTRACT

A disk assembly includes a first disk, a second disk and a third disk. The first disk is engaged with a compressor section of a gas turbine. The second disk is engaged with a turbine section of the gas turbine. The third disk is disposed between the first and second disks and transfers a rotational torque applied to the second disk to the first disk. A through-hole is defined through the third disk along an axial direction of the gas turbine. A distance between the third disk and a tie rod is less than each of distances between the first and second disks and the tie rod, such that spaces are defined by surfaces of the third disk respectively in communication with the compressor section and the turbine section.

17 Claims, 3 Drawing Sheets

(51) Int. Cl.

| | |
|---|---|
| ***F01D 5/10*** | (2006.01) |
| ***F04D 29/58*** | (2006.01) |
| ***F01D 5/06*** | (2006.01) |
| ***F01D 5/18*** | (2006.01) |
| ***F01D 5/30*** | (2006.01) |
| ***F04D 29/32*** | (2006.01) |

(52) U.S. Cl.
CPC ..... *F01D 5/187* (2013.01); *F01D 5/3007* (2013.01); *F04D 29/054* (2013.01); *F04D 29/321* (2013.01); *F04D 29/584* (2013.01); *F05D 2220/32* (2013.01); *F05D 2260/20* (2013.01)

(58) Field of Classification Search
CPC ..... F01D 5/10; F01D 5/025; F01D 11/003; F04D 29/668; F05D 2240/58
USPC ..... 415/116
See application file for complete search history.

(56) References Cited

U.S. PATENT DOCUMENTS

2008/0159864 A1* 7/2008 Hoell ..... F01D 5/026 416/179
2011/0247346 A1* 10/2011 Kimmel ..... F01D 5/081 60/806

FOREIGN PATENT DOCUMENTS

| | | | |
|---|---|---|---|
| EP | 1970529 | A1 | 9/2008 |
| JP | 2007-529668 | A | 10/2007 |
| JP | 2009-103087 | A | 5/2009 |
| JP | 2013-516566 | A | 5/2013 |
| WO | 2008110429 | A1 | 9/2008 |

* cited by examiner

DISK ASSEMBLY AND TURBINE INCLUDING THE SAME

CROSS-REFERENCE(S) TO RELATED APPLICATION

This application claims priority to Korean Patent Application No. 10-2015-0169988, filed on Dec. 1, 2015, the disclosure of which is incorporated herein by reference in its entirety.

BACKGROUND

Exemplary embodiments of the present disclosure relate to a disk assembly and a turbine including the same, and more particularly, to a disk assembly disposed between a compressor section and a turbine section in a gas turbine and transferring a rotational torque generated by the turbine section to the compressor section, and a turbine including the same.

A gas turbine is a kind of motor which acquires a rotational force by injecting combustion gas toward blades of a turbine, and may be divided into a compressor, a combustor and a turbine. The compressor serves to receive a part of power generated through rotations of the turbine, and compress introduced air at high pressure, and the compressed air is transferred to the combustor.

The combustor generates a high-temperature combustion gas flow by mixing and combusting the compressed air and fuel, and injects the generated combustion gas toward the turbine. The injected combustion gas rotates the turbine to generate a rotational force.

The compressor and the turbine include a plurality of rotor disks having blades radially coupled to the outer circumference thereof. Typically, the compressor includes a larger number of rotor disks than the turbine. Hereafter, the plurality of rotor disks arranged in the compressor is referred to as a compressor section, and the plurality of rotor disks arranged at the turbine is referred to as a turbine section.

Each of the rotor disks is coupled to an adjacent rotor disk such that the rotor disks are rotated together. Furthermore, the rotor disks are fixed against each other through a tie rod, and thus not moved in the axial direction.

The tie rod may be inserted through the centers of the respective rotor disks, and the rotor disks may be fastened through nuts coupled to both ends of the tie rod, and thus not moved in the axial direction.

Since the combustor is arranged between the compressor section and the turbine section, the compressor section and the turbine section are separated from each other so as to form a space in which the combustor is to be disposed. Since the tie rod restricts only the axial movement of the rotor disks, the rotor disks can be freely rotated about the tie rod. Thus, a torque transfer member must be additionally installed to transfer a rotational torque generated by the turbine section to the compressor section via the combustor.

An example of the torque transfer member is a torque tube. The torque tube has a hollow cylindrical shape, and both ends of the torque tube are coupled to the last rotor disk of the compressor section and the first rotor disk of the turbine section, respectively, such that a torque is transferred therebetween.

The torque tube must be resistant to deformation and distortion, because the gas turbine is continuously operated for a long term. Furthermore, the torque tube must be easily assembled/disassembled in order to facilitate maintenance. Furthermore, since the torque tube also functions as an air flow path through which cooling air supplied from the compressor section is transferred to the turbine section, the cooling air must be able to be smoothly supplied.

BRIEF SUMMARY

The present disclosure has been made in view of the above problems, and it is an object of the present disclosure to provide a torque transfer unit which is enhanced more than a conventional torque tube.

Also, it is an object of the present disclosure to provide a turbine having a torque transfer unit.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the apparatus and methods as claimed and combinations thereof.

In accordance with one aspect of the present disclosure, a disk assembly may include: a first disk engaged with a compressor section of a gas turbine; a second disk engaged with a turbine section of the gas turbine; a third disk disposed between the first and second disks, transferring a rotational torque applied to the second disk to the first disk, and having a through-hole formed therethrough along an axial direction of the gas turbine; and a damper ring disposed between the inner circumferential surface of the third disk and the outer circumferential surface of the tie rod of the gas turbine, and fixing the third disk in a radial direction of the tie rod. A distance between the third disk and a tie rod may be set to be smaller than distances between the first and second disks and the tie rod, such that the third disk has spaces formed at both surfaces thereof, the spaces communicating with the compressor section and the turbine section, respectively.

The first to third disks may have outer rims formed at the outside thereof in the radial direction, the outer rims being engaged with the compressor section and the turbine section, respectively.

The third disk may include an inner rim which is disposed at a more inner position in the radial direction than the outer rim, and faces the tie rod.

The second disk may have a through-hole formed between the outer rim and the tie rod.

The damper ring may be disposed between the inner rim and the tie rod.

The third disk may have first and second air storage spaces formed at both surfaces thereof, and the first and second air storage spaces may communicate with each other through the through-hole.

The first and second air storage spaces may include inner spaces of the first and second disks, respectively.

The outer surface of the inner rim in the radial direction may be formed with a tapered surface.

The third disk may have an H-shaped cross-section.

The third disk may have a T-shaped cross-section.

In accordance with another aspect of the present disclosure, a disk assembly may include: a first disk engaged with a compressor section of a gas turbine; a second disk engaged with a turbine section of the gas turbine; a third disk disposed between the first and second disks, and transferring a rotational torque applied to the second disk to the first disk; and a cooling air flow path formed through the first to third disks. The third disk may include a guide unit for increasing radial movement of cooling air passing through the cooling air flow path.

In accordance with another aspect of the present disclosure, a gas turbine may include: a compressor section having a plurality of compressor-side rotor disks; a turbine section having a plurality of turbine-side rotor disks arranged at the downstream side of the compressor-side rotor disks; a tie rod disposed through the rotor disks of the compressor section and the turbine section, and contacting the rotor disks with each other; and a disk assembly disposed between the compressor section and the turbine section.

It is to be understood that both the foregoing general description and the following detailed description of the present disclosure are exemplary and explanatory and are intended to provide further explanation of the invention(s) as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Hereafter, referring to the accompanying drawings, a disk assembly and a gas turbine including the same according to an embodiment of the present disclosure will be described in detail.

Figure 1:
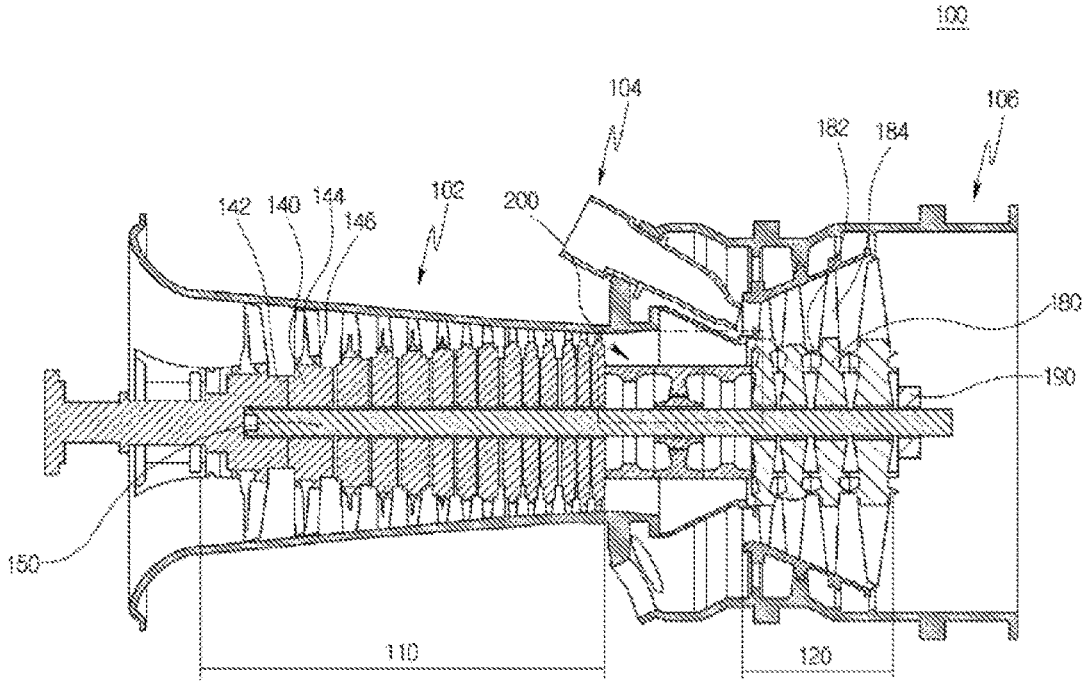
FIG. 1 is a cross-sectional view schematically illustrating the internal structure of a gas turbine to which a disk assembly according to a first embodiment of the present disclosure is applied.

FIG. 1 is a cross-sectional view schematically illustrating the internal structure of a gas turbine 100 to which a disk assembly 200 according to a first embodiment of the present disclosure is applied. Referring to FIG. 1, the turbine 100 includes a body 102 and a diffuser 106. The diffuser 106 is disposed at the rear of the body 102 and discharges combustion gas passed through the turbine. The turbine 100 further includes a combustor 104 disposed at the front of the diffuser 106, and receiving and combusting compressed air.

Based on an air flow direction, a compressor section 110 is positioned at the upstream side of the body 102, and a turbine section 120 is disposed at the downstream side of the body 102. Between the compressor section 110 and the turbine section 120, a disk assembly 200 is disposed as a torque transfer member which transfers a rotational torque generated by the turbine section to the compressor section. The compressor section 110 includes a total of 14 compressor rotor disks 140, and the compressor rotor disks 140 are fastened to each other through one tie rod 150 so as not to be separated from each other in the axial direction.

Specifically, the compressor rotor disks 140 are arranged along the axial direction while the tie rod is inserted through the centers of the compressor rotor disks 140. Each of the compressor rotor disks 140 includes a plurality of protrusions formed around the outer circumference thereof, and has a flange 142 protruding in the axial direction so as not to be relatively rotated about an adjacent rotor disk.

The compressor rotor disk 140 has a plurality of blades 144 radially coupled to the outer circumferential surface thereof. Each of the blades 144 is coupled to the compressor rotor disk 140 through a dove tail part 146. However, the coupling method between the blade 144 and the compressor rotor disk 140 is not limited to the dove tail.

The turbine section 120 includes four turbine rotor disks 180. Each of the turbine rotor disks 180 basically has a similar shape to the compressor rotor disk. Therefore, the turbine rotor disk 180 also has a flange 182 having coupling protrusions coupled to an adjacent turbine rotor disk, and includes a plurality of turbine blades 184 which are radially arranged. Each of the turbine blades 184 may also be coupled to the turbine rotor disk 180 through a dove tail part.

The tie rod 150 is disposed through the centers of the plurality of compressor rotor disks 140. One end of the tie rod 150 is fastened to the compressor rotor disk positioned at the most upstream side, and the other end thereof is fastened to a fixing nut 190 disposed at the downstream side of the turbine rotor disk positioned at the most downstream side. Specifically, the other end of the tie rod 150 is screwed to the fixing nut 190, and the fixing nut pressurizes the turbine-side rotor disk disposed at the most downstream side in the axial direction. Thus, the plurality of disks arranged along the tie rod 150 are fixed against each other so as not to be moved in the axial direction.

The disk assembly 200 is fixed in a state where both ends thereof are in contact with the compressor section 110 and the turbine section 120, respectively. That is, the compressor section-side end of the disk assembly is in contact with the compressor rotor disk at the most downstream side, and the turbine section-side end of the disk assembly is in contact with the turbine rotor disk at the most upstream side. As described above, the disk assembly has a plurality of protrusions formed thereon, and may be fixed so as not to relatively rotate about the rotor disks.

The above-described gas turbine has a structure in which one tie rod is extended across the compressor and turbine. However, the structure is not limited thereto. For example, a structure in which separate tie rods are installed at the compressor and the turbine, respectively, may be considered. Instead of one tie rod disposed through the centers of the respective disks, a structure having a plurality of tie rods radially arranged through the disks may be considered. In another example, one tie rod may be disposed through the center of any one of the compressor section and the turbine section, and a plurality of tie rods may be radially arranged through the other section.

Now, referring to FIG. 2, the disk assembly 200 will be described in detail.

Figure 2:
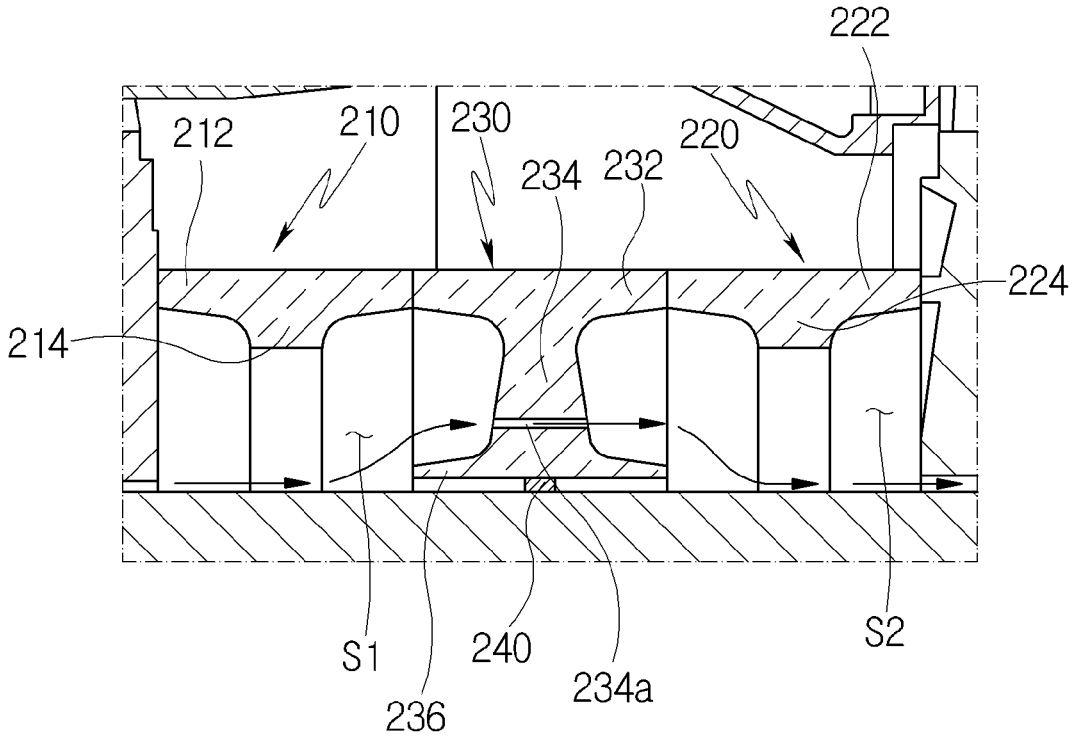
FIG. 2 is an expanded cross-sectional view of the first embodiment of FIG. 1.

Referring to FIG. 2, the disk assembly 200 includes three disks. Each of the three disks commonly has a hole formed in the center thereof, such that the tie rod passes through the hole. However, while the first and second disks 210 and 220 have substantially the same shape, the third disk 230 has a smaller inner diameter than the first and second disks. Hereafter, the disks will be described in detail.

The first disk 210 has a T-shaped side cross-section. Specifically, the first disk includes a disk body 214 and an outer rim 212. The outer rim 212 is formed at the outer circumference of the disk body 214 so as to protrude toward both sides along the axial direction of the tie rod. The outer rim 212 is disposed against the adjacent disks, and coupled to the disks such that the disks do not relatively rotate about each other. For example, the outer rim 212 having a friction surface formed thereon may be coupled to the compressor-side rotor disk or the third disk by a pressurizing force of the fixing nut. Thus, the outer rim 212 may not be slid on the surface of the compressor-side rotor disk or the third disk.

Besides, the outer rim 212 may be fastened to the adjacent disks through a plurality of protrusions formed on the surface thereof.

One end of the disk body 214 of the first disk, or specifically an end facing the tie rod 150 is spaced from the surface of the tie rod. Specifically, the first disk has a cross-section of which the height is smaller than the width thereof, based on FIG. 2. Thus, the first disk has an internal space in which the tie rod is disposed. The internal space and a side surface of the third disk to be described later form a first air storage space S1. The first air storage space S1 will be described later.

The second disk 220 basically has a similar shape to the first disk. That is, the second disk 220 may also have a T-shaped side cross-section. Like the first disk, the second disk 220 includes a disk body 224 and an outer rim 222. The outer rim 222 is formed at the outer circumference of the disk body so as to protrude toward both sides along the axial direction of the tie rod. The outer rim 222 of the second disk 220 is also disposed against the adjacent disks, and coupled to the disks such that the disks do not relatively rotate about each other.

For example, the outer rim 222 having a friction surface thereon may be coupled to the turbine-side rotor disk or the third disk by a pressurizing force of the fixing nut. Thus, the outer rim 222 may not be slid on the surface of the turbine-side rotor disk or the third disk. The outer rim 222 may also be fastened to the adjacent disks through a plurality of protrusions formed on the surface thereof.

The second disk forms a second air storage space S2 similar to the air storage space of the first disk.

The third disk has a different shape from the first and second disks. As illustrated in FIG. 2, the third disk 230 is formed in an H-shape. Specifically, the third disk 230 includes a disk body 234 and an outer rim 232 formed on the outside of the disk body in the radial direction. The outer rim 232 may have the same shape as those of the first and second disks. The disk body 234 has a through-hole 234*a* extending along the longitudinal direction of the tie rod 150.

The through-hole 234*a* functions as a flow path through which cooling air is passed. FIG. 2 illustrates that the through-hole is formed in parallel to the longitudinal direction of the tie rod. However, the through-hole 234*a* is not limited thereto, but may have an arbitrary shape as long as the through-hole is formed through the disk body 234.

For example, the through-hole may be inclined in a lower-right or upper-right direction based on FIG. 2.

The disk body 234 has an inner rim 236 formed therein in the radial direction thereof. The inner rim 236 is extended along the longitudinal direction of the tie rod from both surfaces of the disk body 234. Based on FIG. 2, the top surface of the inner rim 236 is formed with a tapered surface.

The third disk 230 has a hole formed in the center thereof such that the tie rod 150 is passed through the hole. The hole has a smaller inner diameter than those of the first and second disks. Thus, as illustrated in FIG. 2, first and second air storage spaces S1 and S2 are defined at both surfaces of the main body of the third disk 230. The first and second air storage spaces S1 and S2 are defined by the internal spaces of the first and second disks and the spaces existing at both surfaces of the disk body of the third disk.

The first air storage space S1 formed between the first and third disks 210 and 230 functions as a space in which cooling air extracted from the compressor section is primarily stored. The second air storage space S2 functions as a space in which cooling air to be injected to the turbine section temporarily stays.

The through-hole 234*a* serves to connect the two air storage spaces S1 and S2 to each other. Thus, the cooling air stored in the first air storage space may be introduced into the second air storage space through the through-hole 234*a*. The introduced cooling air temporarily stays in the second air storage space, and is then supplied toward the turbine section.

At this time, the tapered surface disposed before and after the through-hole 234*a* serves to guide the cooling air to naturally head toward the through hole. Thus, the cooling air flows along the tie rod in the first and second disks. In the third disk, however, the cooling air flows while being separated from the tie rod. Based on FIG. 2, the cooling air rises and falls before and after the third disk 230. Such a structure increases the momentum of the cooling air in the vertical direction (based on FIG. 2), such that the cooling air can be uniformly mixed.

As illustrated in FIG. 2, the disk assembly according to the first embodiment has a structure in which the second disk having a relatively small inner diameter is disposed between the two disks having the inner rim facing the tie rod 150. Thus, while the disk assembly is stably supported with respect to the tie rod, the weight thereof can be reduced or minimized.

Furthermore, in the first embodiment, the coupling among the three disks having ends facing the tie rod 150 is maintained by the axial pressure of the tie rod. At this time, in order to support the first to third disks in the radial direction, a tension ring 240 is inserted between the end of the third disk and the tie rod 150.

The tension ring 240 is made of an elastic material. Based on FIG. 2, the top surface of the tension ring 240 is supported against the inner rim 236, and the bottom surface of the tension ring 240 is supported against the outer circumferential surface of the tie rod 150. Therefore, the tension ring can absorb vibration which may be generated during operation, reduce or prevent a reduction in life time of the device, and reduce or minimize an occurrence of noise.

In the example illustrated in FIG. 2, only the third disk includes the tension ring. This is because vibration can be absorbed to a required extent by one tension ring, since the three disks are fixed against each other between the compressor and turbine sections in the axial direction by the tie rod. Furthermore, that is in order to allow cooling air to flow through the third disk.

In the above-described embodiment, an H-shaped disk is arranged between two T-shaped disks. However, the number of disks and the arrangement order thereof may be changed. Furthermore, the first and second disks are separated from each other, and supported against each other through the third disk. In order to improve the vibration absorption performance, an additional member may be installed to connect the first and second disks.

Figure 3:
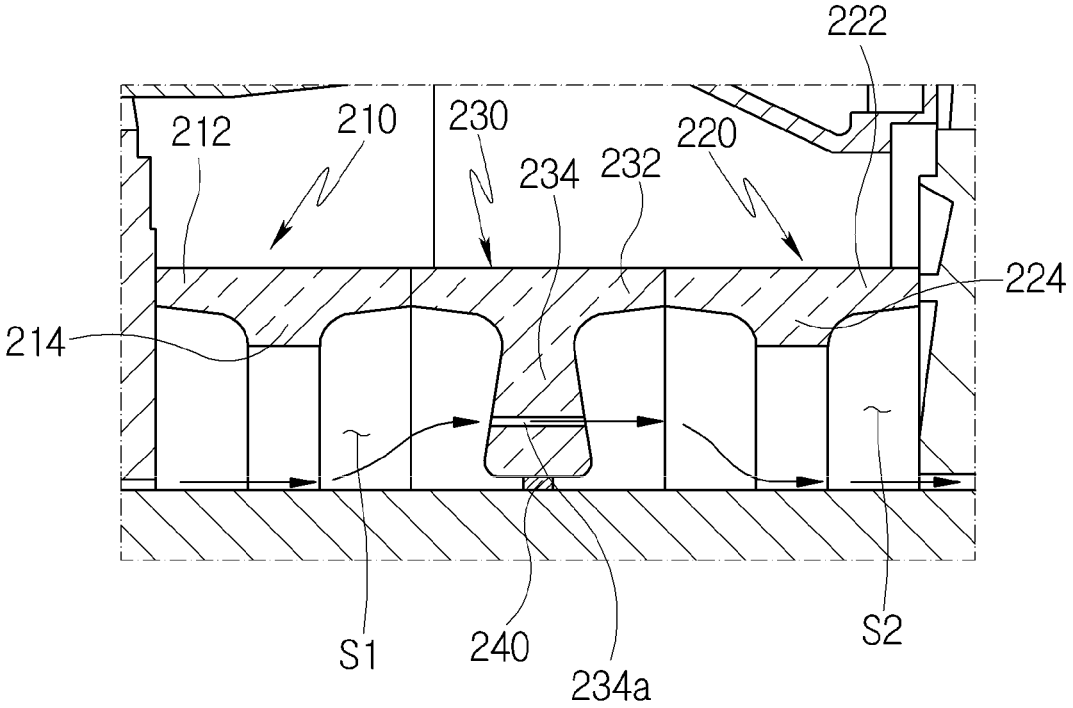
FIG. 3 is an expanded cross-sectional view of a disk assembly according to a second embodiment of the present disclosure.

FIG. 3 illustrates a disk assembly according to a second embodiment. The second embodiment basically has the same structure as the first embodiment. However, the second embodiment is different from the first embodiment in that the third disk has a T-shape instead of an H-shape. That is, the third disk according to the second embodiment does not have an inner rim which is included in the third disk according to the first embodiment. Therefore, the entire weight of the disk assembly can be further reduced.

In accordance with the embodiments of the present disclosure, since the disk assembly uses the plurality of disks as a torque transfer member, a fixing operation for the tie rod may be facilitated. Furthermore, since one or more disks are supported against the tie rod by the tension ring in the radial direction, vibration and noise caused by the disk assembly can be minimized during the torque transfer process.

Furthermore, since two disks having a small weight are disposed at both sides of the third disk positioned in the center, the structural stability can be further improved. It will be apparent to those skilled in the art that various changes and modifications may be made without departing from the spirit and scope of the following claims.

Moreover, the above advantages and features are provided in described embodiments, but shall not limit the application of the claims to processes and structures accomplishing any or all of the above advantages.

What is claimed is:

1. A disk assembly for a gas turbine, the gas turbine including a tie rod on which a compressor section and a turbine section are rotated, the disk assembly comprising:

a first disk that is configured to be engaged with the compressor section and has a first internal space in which the tie rod can be disposed, the first disk including a first disk body (214) separating upstream and downstream sides of the first disk;

a second disk that is configured to be engaged with the turbine section and has a second internal space in which the tie rod can be disposed, the second disk including a second disk body (224) separating upstream and downstream sides of the second disk;

a third disk disposed between the first and second disks and configured to transfer a rotational torque applied to the second disk to the first disk, the third disk including a main body having an upstream surface communicating with the first internal space of the first disk to define a first air storage space (S1) and having a downstream surface communicating with the second internal space of the second disk to define a second air storage space (S2); and a tension ring disposed between an inner circumferential surface of the third disk and an outer circumferential surface of the tie rod and configured to fix the third disk in a radial direction of the tie rod, the tension ring being formed of an elastic material and including an upstream surface disposed downstream of the upstream surface of the third disk and a downstream surface disposed upstream of the downstream surface of the third disk so as to be centrally positioned between the upstream and downstream surfaces of the third disk, wherein the main body of the third disk defines a through-hole along an axial direction of the gas turbine, and the first air storage space, the through-hole, and the second air storage space form a cooling air flow path, wherein the first air storage space is formed on the downstream side of the first disk between the first and third disks and primarily stores cooling air extracted from the compressor section via the upstream side of the first disk, and the second air storage space is formed on the upstream side of the second disk between the third and second disks and temporarily stores cooling air to be injected to the turbine section via the downstream side of the second disk, and wherein the extracted cooling air radially rises in the cooling air flow path before the third disk, and the cooling air to be injected radially falls in the cooling air flow path after the third disk.

2. The disk assembly of claim 1, wherein the third disk further includes an inner rim that faces the tie rod and increases the momentum of the cooling air in a radial direction of the tie rod.

3. The disk assembly of claim 2, wherein the inner rim has an outer surface on which a guide is formed, and wherein the guide includes:

a first tapered surface rising toward the main body and communicating with the upstream surface; and a second tapered surface falling from the main body and communicating with the downstream surface.

4. The disk assembly of claim 2, wherein the third disk has an H-shaped cross-section including an outer rim respectively engaged with the first and second disks.

5. The disk assembly of claim 4, wherein the main body of the third disk radially extends from the inner rim, and the upstream and downstream surfaces each include a tapered surface narrowing the main body toward the outer rim.

6. The disk assembly of claim 1, wherein the third disk has a T-shaped cross-section including an outer rim respectively engaged with the first and second disks.

7. The disk assembly of claim 6, wherein the main body of the third disk radially extends from the inner circumferential surface, and the upstream and downstream surfaces each include a tapered surface narrowing the main body toward the outer rim.

8. The disk assembly of claim 1, wherein the cooling air flows along the tie rod in the first internal space of the first disk in the second internal space of the second disk and is separated from the tie rod while flowing through the third disk.

9. The disk assembly of claim 1, wherein the first, second, and third disks each have an outer rim, and the outer rims of the first and third disks engage with the compressor section and the turbine section, respectively, and wherein the first internal space of the first disk communicates with the compressor section and with the tie rod, and the second internal space of the second disk communicates with the turbine section and with the tie rod.

10. A disk assembly for a gas turbine, the gas turbine including a tie rod on which a compressor section and a turbine section are rotated, the disk assembly comprising:

a first disk that is configured to be engaged with the compressor section and has a first internal space in which the tie rod can be disposed, the first disk including a first disk body separating upstream and downstream sides of the first disk;

a second disk that is configured to be engaged with the turbine section and has a second internal space in which the tie rod can be disposed, the second disk including a second disk body separating upstream and downstream sides of the second disk;

a third disk disposed between the first and second disks and configured to transfer a rotational torque applied to the second disk to the first disk, the third disk including a main body having an upstream surface communicating with the first internal space of the first disk to define a first air storage space (S1) on the downstream side of the first disk between the first and third disks and having a downstream surface communicating with the second internal space of the second disk to define a second air storage space (S2) on the upstream side of the second disk between the third and second disks; and a cooling air flow path for passing cooling air from the first air storage space to the second air storage space, wherein the third disk further includes an inner rim that faces the tie rod and increases the momentum of the cooling air in a radial direction of the tie rod, and wherein the disk assembly further comprises:

a tension ring disposed between the inner rim and the tie rod and configured to fix the third disk in a radial direction of the tie rod, the tension ring being formed of an elastic material and including an upstream surface disposed downstream of the upstream surface of the third disk and a downstream surface disposed upstream of the downstream surface of the third disk so as to be centrally positioned between the upstream and downstream surfaces of the third disk.

11. The disk assembly of claim 10, wherein the inner rim has an outer surface on which a guide is formed, and wherein the guide includes:

a first tapered surface rising toward the main body and communicating with the upstream surface; and a second tapered surface falling from the main body and communicating with the downstream surface.

12. The disk assembly of claim 10, wherein the third disk has an H-shaped cross-section including an outer rim respectively engaged with the first and second disks.

13. The disk assembly of claim 12, wherein the main body of the third disk radially extends from the inner rim, and the upstream and downstream surfaces each include a tapered surface narrowing the main body toward the outer rim.

14. The disk assembly of claim 10, wherein the cooling air flows along the tie rod in the first internal space of the first disk in the second internal space of the second disk and is separated from the tie rod while flowing through the third disk.

15. The disk assembly of claim 10, wherein the first air storage space is formed between the first and third disks and primarily stores cooling air extracted from the compressor section, and the second air storage space is formed between the third and second disks and temporarily stores cooling air to be injected to the turbine section, and wherein the extracted cooling air radially rises in the cooling air flow path before the third disk, and the cooling air to be injected radially falls in the cooling air flow path after the third disk.

16. The disk assembly of claim 10, wherein the main body of the third disk defines a through-hole along an axial direction of the gas turbine, and the first air storage space, the through-hole, and the second air storage space form the cooling air flow path.

17. A gas turbine comprising:

a tie rod;

a compressor section including a plurality of compressor rotor disks configured to rotate on the tie rod;

a turbine section including a plurality of turbine rotor disks configured to rotate on the tie rod and arranged downstream of the compressor rotor disks; and a disk assembly disposed between the compressor section and the turbine section, the disk assembly including:

a first disk that is configured to be engaged with the compressor section and has a first internal space in which the tie rod can be disposed, the first disk including a first disk body separating upstream and downstream sides of the first disk;

a second disk that is configured to be engaged with the turbine section and has a second internal space in which the tie rod can be disposed, the second disk including a second disk body separating upstream and downstream sides of the second disk;

a third disk disposed between the first and second disks and configured to transfer a rotational torque applied to the second disk to the first disk, the third disk including a main body having an upstream surface communicating with the first internal space of the first disk to define a first air storage space (S1) and having a downstream surface communicating with the second internal space of the second disk to define a second air storage space (S2); and a tension ring disposed between an inner circumferential surface of the third disk and an outer circumferential surface of the tie rod and configured to fix the third disk in a radial direction of the tie rod, the tension ring being formed of an elastic material and including an upstream surface disposed downstream of the upstream surface of the third disk and a downstream surface disposed upstream of the downstream surface of the third disk so as to be centrally positioned between the upstream and downstream surfaces of the third disk, wherein the main body of the third disk defines a through-hole along an axial direction of the gas turbine, and the first air storage space, the through-hole, and the second air storage space form a cooling air flow path, wherein the first air storage space is formed on the downstream side of the first disk between the first and third disks and primarily stores cooling air extracted from the compressor section via the upstream side of the first disk, and the second air storage space is formed on the upstream side of the second disk between the third and second disks and temporarily stores cooling air to be injected to the turbine section via the downstream side of the second disk, and wherein the extracted cooling air radially rises in the cooling air flow path before the third disk, and the cooling air to be injected radially falls in the cooling air flow path after the third disk.

* * * * *